US012369653B2

(12) United States Patent
Hirakubo

(10) Patent No.: US 12,369,653 B2
(45) Date of Patent: Jul. 29, 2025

(54) WOMAN'S UNDERGARMENT WITH CUP SECTIONS

(71) Applicant: GOLD FLAG LTD., Osaka (JP)

(72) Inventor: Akiyo Hirakubo, Osaka (JP)

(73) Assignee: GOLD FLAG LTD., Osaka (JP)

( * ) Notice: Subject to any disclaimer, the term of this patent is extended or adjusted under 35 U.S.C. 154(b) by 0 days.

(21) Appl. No.: 18/859,904

(22) PCT Filed: Nov. 24, 2023

(86) PCT No.: PCT/JP2023/042243
§ 371 (c)(1),
(2) Date: Oct. 24, 2024

(87) PCT Pub. No.: WO2025/109765
PCT Pub. Date: May 30, 2025

(65) Prior Publication Data
US 2025/0169553 A1 May 29, 2025

(51) Int. Cl.
*A41C 3/12* (2006.01)

(52) U.S. Cl.
CPC ..... *A41C 3/12* (2013.01)

(58) Field of Classification Search
CPC ..... A41C 3/12
See application file for complete search history.

(56) References Cited

U.S. PATENT DOCUMENTS 2,134,294 A * 10/1938 Yerkes ..... A41C 3/00 450/59
2,523,715 A * 9/1950 Panes ..... A41C 3/00 D2/709
2,592,792 A * 4/1952 Cohen ..... A41C 3/0021 450/63

(Continued)

FOREIGN PATENT DOCUMENTS

CN 1319360 A 10/2001
CN 202653171 U 1/2013

(Continued)

OTHER PUBLICATIONS

Office Action, dated Oct. 22, 2024, issued for the corresponding Taiwanese Patent Application No. 113116537, 12 pages, with English translation.

(Continued)

*Primary Examiner* — Gloria M Hale
(74) *Attorney, Agent, or Firm* — LUCAS & MERCANTI, LLP

(57) ABSTRACT

A woman's undergarment includes a pair of left and right brassiere cups each having a lower edge, a side edge, and an upper edge, cover pieces each disposed to cover an outer surface of the brassiere cup, straps, and lift-up pieces. The brassiere cup has a double structure including an inner cup and an outer cup, and has an opening in a corner region including a portion where an upper edge and a side edge of the outer cup meet. The lift-up piece is disposed between the (Continued)

inner cup and the outer cup, and includes an insertion portion having a strip shape and inserted through the opening in the corner region of the outer cup from an inner surface to an outer surface.

5 Claims, 7 Drawing Sheets

(56) References Cited

U.S. PATENT DOCUMENTS

| | | | | |
|---|---|---|---|---|
| 2,632,168 | A * | 3/1953 | Kaufman | A41C 3/0021 450/87 |
| 2,842,137 | A * | 7/1958 | Becker | A41C 3/0021 450/36 |
| 8,075,368 | B2 * | 12/2011 | Puyaubreau | A41C 3/14 450/72 |
| 8,690,634 | B2 * | 4/2014 | Heath | A41C 3/0057 450/40 |
| 9,332,789 | B2 | 5/2016 | Campbell | |
| 10,334,891 | B2 * | 7/2019 | Weber-Unger | A41C 3/12 |
| 10,568,365 | B2 * | 2/2020 | Hirakubo | A41F 15/002 |
| 10,856,586 | B2 * | 12/2020 | Hirakubo | A41C 3/142 |
| 10,897,934 | B2 * | 1/2021 | Hirakubo | A41C 3/144 |
| 2005/0221718 | A1 | 10/2005 | Falla | |
| 2006/0223414 | A1 * | 10/2006 | Staub | A41C 3/0057 450/1 |
| 2008/0022434 | A1 | 1/2008 | Adelman | |
| 2011/0201252 | A1 * | 8/2011 | Campbell | A41C 3/00 450/39 |
| 2012/0122370 | A1 * | 5/2012 | Heath | A41C 3/0057 450/80 |
| 2014/0349550 | A1 * | 11/2014 | Campbell | A41C 3/0021 450/60 |
| 2015/0056890 | A1 * | 2/2015 | Black | A41C 3/146 450/86 |
| 2016/0338423 | A1 * | 11/2016 | Weber-Unger | A41C 3/10 |
| 2020/0281282 | A1 | 9/2020 | Hirakubo | |

FOREIGN PATENT DOCUMENTS

| | | | |
|---|---|---|---|
| JP | 2001-254207 | A | 9/2001 |
| JP | 2005-307363 | A | 11/2005 |
| JP | 2013-072161 | A | 4/2013 |
| JP | 2015-212437 | A | 11/2015 |
| JP | 2016-069763 | A | 5/2016 |
| JP | 6446605 | B1 | 12/2018 |
| TW | 201929704 | A | 8/2019 |
| TW | 202002821 | A | 1/2020 |
| WO | 2019/224965 | A1 | 11/2019 |

OTHER PUBLICATIONS

International Search Report dated Feb. 6, 2024, issued for the corresponding International patent application No. PCT/JP2023/042243.

Notice of Reasons for Refusal dated Mar. 19, 2024, issued for the corresponding Japanese Patent Application No. 2024-512175, with an English translation.

Extended European Search Report, dated Apr. 22, 2025, issued for the corresponding European Patent Application No. 23927830.2, 6 pages.

* cited by examiner (a)

(b)

WOMAN'S UNDERGARMENT WITH CUP SECTIONS

CROSS REFERENCE TO RELATED APPLICATION

This Application is a 371 of PCT/JP2023/042243 filed on Nov. 24, 2023, which is incorporated herein by reference.

TECHNICAL FIELD

The present invention relates to women's undergarments with cup sections, such as brassieres and camisoles.

BACKGROUND ART

There are two types of women's undergarments with cup sections, typified by brassieres. One is an underwire cup-type undergarment provided with arc-shaped wires along the lower edges of the cup sections, and the other is a wireless cup-type undergarment without such wires. The latter type of women's undergarments with wire-free cup sections are referred to as "wireless undergarments (or wireless brassieres) for women".

For example, a woman's wireless undergarment (wireless brassiere) includes: left and right cup sections adapted to cover breasts; a support panel optionally sewn to the lower edges of the cup sections to support the cup sections; back portions each extending from the support panel to cover the back; and straps each provided to connect the cup section and the back portion. In the case of a woman's underwire undergarment (brassiere), an arc-shaped wire is inserted along the lower edge of each cup section. This wire helps to maintain the cup section in the arc shape of the wire.

Wearers of women's undergarments have a wide variety of body shapes, especially in breast regions, such as large breasts and small breasts, thick chests and thin chests, broad shoulders and narrow shoulders, and square shoulders and sloping shoulders.

One of the major and common functional requirements for such cup sections of women's undergarments is to push the breasts upwardly and inwardly toward the center of the chest so as to create a beautiful decollete in the neckline area, or to enhance the breast-shaping function. Examples of the other important functional requirements include improvements in wearing feeling, such as better fit obtained when form-fitting cup sections are in close contact with wearer's breasts and hold the breasts firmly, regardless of the wearer's body shape, and increased wearing comfort (obtained, for example, when brassiere cups are not detached from the breasts even if the wearer twists her body from side to side, when the breasts do not spill out of the edges of the brassiere cups even if the wearer waves her arms, when the brassiere does not slide up even if the wearer raises her hands, when the straps do not slip off the shoulders even if the wearer turns her shoulders, when the breasts do not swing wildly even if the wearer jumps, and when the back belt of the brassiere does not slide up even if the wearer leans forward).

Patent Literature 1 is an invention relating to a woman's undergarment with an improved breast-shaping function and uses lift-up pieces to create ample breasts. In each of the lift-up pieces, the upper end is sewn to the breast-side end portion of a strap together with the upper lateral corner region of a brassiere cup, and the lower edge is sewn to the cup-shaped edge of a support panel together with the lower edge of the brassiere cup. Thus, the lift-up piece is provided to extend obliquely downward from the breast-side end portion of the strap to the cup-shaped edge of the support panel.

A portion of the brassiere cup covered by the lift-up piece is a region extending in the lower and lateral parts of the outer surface of the brassiere cup, and the lift-up piece entirely covers that region. The effect of the lift-up pieces is as follows. When a user wears the brassiere, the straps each pull the lift-up piece placed along the contour of the under-arm-side and lower parts of the breast in the brassiere cup. Then, the lift-up pieces push the entire breasts inwardly and upwardly, and as a result, the breasts are pushed toward the front center of the chest and a beautiful decollete is created in the neckline area.

A conventional woman's undergarment Z according to Patent Literature 2 (FIG. 7) includes a pair of left and right brassiere cups 100, cup cover pieces 120, straps 170, back pieces 107, a support panel 110, and lift-up pieces 140, and exhibits the effect of creating a beautiful decollete with the lift-up pieces 140 in the same manner as in Patent Literature 1.

In addition, a lower edge 102 of each brassiere cup 100 is sewn to a lower edge 122 of each lift-up piece 140. A side edge 104 and an upper edge 103 of the brassiere cup 100 are provided without being sewn to the cup cover piece 120. The lift-up piece 140 is provided between the brassiere cup 100 and the cup cover piece 120. The brassiere cup 100 has an opening 106 in a corner region 109 including an upper end P103, and an insertion portion 146 of the lift-up piece 140 is disposed to pass through the opening 106 from an outer surface 100*s* to an inner surface of the brassiere cup 100 (FIG. 7(*c*)).

In Patent Literature 1, in each of the lift-up pieces, the upper end is sewn to the breast-side end portion of the strap together with the upper lateral corner region of the brassiere cup, and the lower edge is sewn to the cup-shaped edge of the support panel together with the lower edge of the brassiere cup. Thus, when the wearer twists her body from side to side or waves her arms, the brassiere cups are also pulled up and moved by the straps, which may cause the brassiere cups to slide up over the breasts or may, conversely, cause the straps to slip off the shoulders. Therefore, there is a problem in wearing feeling.

Thus, in Patent Literature 2, the brassiere cup 100 has the opening 106 in the corner region 109 including the upper end P103, and the insertion portion 146 of the lift-up piece 140 is disposed so as to pass through the opening 106 from the outer surface 100*s* to the inner surface, to prevent the brassiere cup 100 from being constrained by the movement of the lift-up piece 140. As a result, the problem in wearing feeling of Patent Literature 1 has been solved.

CITATION LIST

Patent Literature

[PTL 1] Japanese Laid-Open Patent Publication No. 2015-212437

[PTL 2] Japanese Patent No. 6446605

SUMMARY OF INVENTION

Technical Problem

However, in Patent Literatures 1, 2, the lift-up piece 140 is disposed on the outer surface 100*s* of the brassiere cup 100. Since the lift-up piece 140 needs a certain amount of tensile strength and elasticity to lift a breast B, a power net fabric is formed in a folded piece and used as the lift-up piece 140, for example, and thus the lift-up piece 140 is thick. As a result, even if the cup cover piece 120 for covering the lift-up piece 140 is used, the upper edge 143 of the lift-up piece 140 becomes visible as a linear level difference 100D on an outerwear 100T when the outerwear 100T is worn, which impairs the appearance. In particular, the level difference 100D becomes remarkably visible on the outerwear 100T, for example, for summer (FIG. 7(*b*)).

In addition, in Patent Literature 2 as described above, the insertion portion 146 of the lift-up piece 140 is inserted so as to pass through the opening 106 in the corner region 109 of the brassiere cup 100 from the outer surface 100*s* to the inner surface, and thus the insertion portion 146 is disposed under the inner surface of the corner region 109 in the corner region 109, and the corner region 109 is pressed outwardly by the insertion portion 146. As a result, the outwardly pressed portion becomes remarkably visible as the level difference 100D on the outerwear 100T as in the above description (FIG. 7(*c*)).

The present invention has been made in view of the above-described problems of conventional examples, and an object of the present invention is to provide a woman's undergarment with cup sections that not only has improved body-shaping function and fit but also is excellent in appearance because lift-up pieces do not affect an outerwear.

Solution to Problem

An invention according to claim 1 relates to a woman's undergarment A with cup sections (FIG. 1).

The woman's undergarment A with cup sections includes:

a pair of left and right brassiere cups 1 each adapted to receive a breast B and having a lower edge 2, a side edge 4, and an upper edge 3, the lower edge 2 being downwardly curved, the side edge 4 rising from an underarm-side end P1 of the lower edge 2 toward the upper edge 3, the upper edge 3 extending from a sternum-side end P2 of the lower edge 2 to an upper end P3 of the side edge 4;

cup cover pieces 20 each disposed to cover an outer surface of the brassiere cup 1 and separated from the outer surface of the brassiere cup 1, in which the lower edge 2 of the brassiere cup 1 extending from the underarm-side end P1 to the sternum-side end P2 is sewn to a lower edge 22 of the cup cover piece 20, and the side edge 4 and the upper edge 3 of the brassiere cup 1 are provided without being sewn to the cup cover piece 20;

straps 70 each sewn to the cup cover piece 20; and lift-up pieces 40 each having a lower edge 42 sewn to the lower edge 2 of the brassiere cup 1, and an upper end edge 45 connected to the strap 70, wherein the brassiere cup 1 is formed to have a double structure including an inner cup 1*i* and an outer cup 1*o* provided on an outer surface of the inner cup 1*i*, the brassiere cup 1 has an opening 6 in a corner region 1o9 including a portion where an upper edge 103 and a side edge 104 of the outer cup 1*o* meet with each other, the lift-up piece 40 is disposed between the inner cup 1*i* and the outer cup 1*o*, the lift-up piece 40 includes an insertion portion 46 having a strip shape extending toward the upper end edge 45, and the insertion portion 46 is inserted through the opening 6 in the corner region 1*o*9 from an inner surface to an outer surface and is provided so as to press against the outer surface of the corner region 1*o*9.

An invention according to claim 2 is the woman's undergarment A with cup sections according to claim 1, wherein the inner cup 1*i* and the outer cup lo have an identical outer shape and are integrally sewn or adhered at entire perimeters thereof.

A invention according to claim 3 is the woman's undergarment A with cup sections according to claim 1, wherein a material of the inner cup 1*i* and the outer cup 1*o* to be used is any one of: a sheet-like foam-laminated fabric having a three-layer structure composed of an interlayer 1*b* made of a foam material and thin fabric layers serving as an outer layer 1*a* and an inner layer 1*c* attached to the interlayer 1*b;* a sheet-like foam-backed fabric having a two-layer structure composed of an interlayer and a thin fabric layer serving as an inner layer 1*c* of the inner cup 1*i* or an outer layer 1*a* of the outer cup 10; a nonwoven fabric; and a woven fabric.

An invention according to claim 4 is the woman's undergarment A according to claim 1, wherein the opening 6 in the corner region 1*o*9 is formed in a slit shape extending in a direction intersecting (perpendicular or approximately perpendicular to) a longitudinal direction of the insertion portion 46.

An invention according to claim 5 is the woman's undergarment A according to claim 4, wherein the opening 6 has a length (slit length) 6*w* greater than a width 46*w* of the insertion portion 46.

Advantageous Effects of Invention

With the configuration described above, the present invention can provide a woman's undergarment with cup sections that not only has improved body-shaping function and fit but also is excellent in appearance because lift-up pieces do not affect an outerwear.

DESCRIPTION OF EMBODIMENTS

Hereinafter, a woman's undergarment A of the present invention will be described. Examples of the woman's undergarment A of the present invention include all types of undergarments with brassiere cups 1, such as brassiere-type, camisole-type (not shown), and other types of undergarments. In this description, a brassiere is described as a typical example and is denoted by the same reference sign A.

Figure 1:
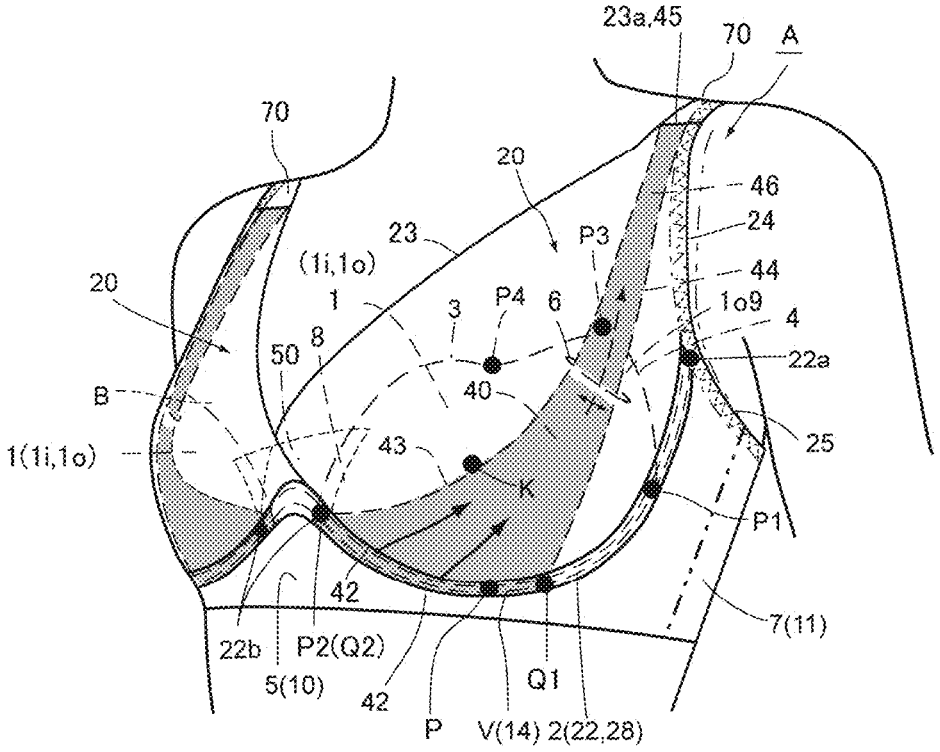
FIG. 1(*a*) is a perspective view of a woman's undergarment (first embodiment) according the present invention on a wearer, and FIG. 1(*b*) is a perspective view of a woman's undergarment (second embodiment) on a wearer.
Figure 1:
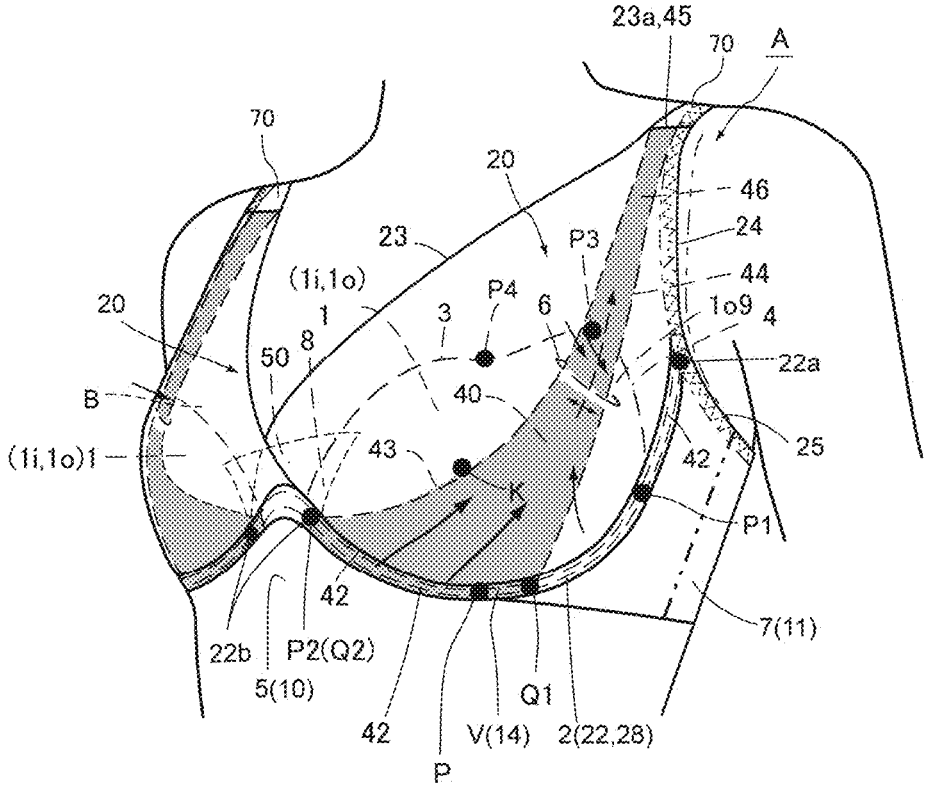
Figure 4:
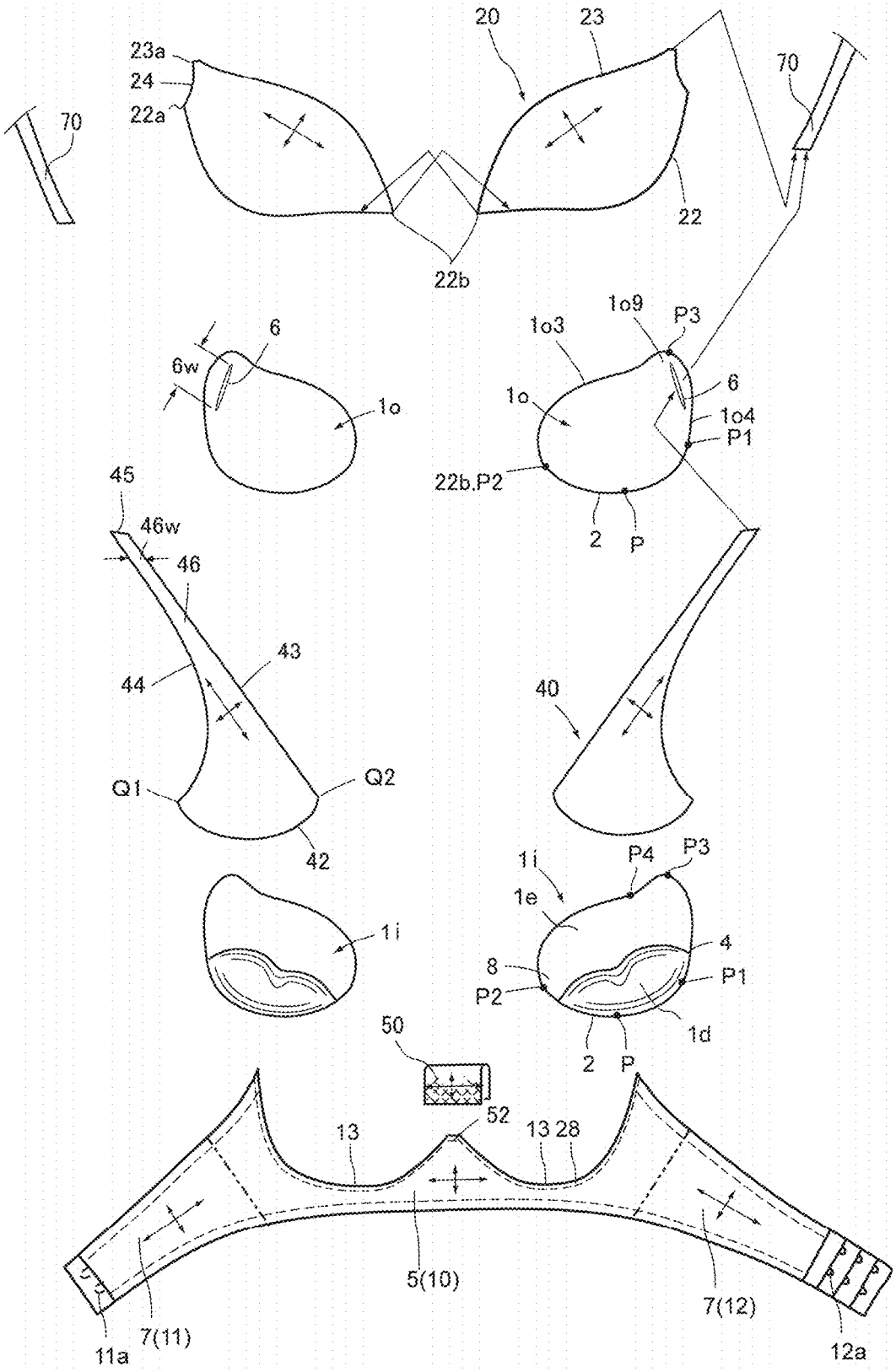
FIG. 4 is an exploded view of the woman's undergarment according to the present invention.

The embodiments of the brassiere A of the present invention are shown in FIG. 1(*a*) to FIG. 4. The brassiere A includes left and right symmetrical brassiere cups 1, cup cover pieces 20, lift-up pieces 40, an optionally provided support panel 10, back pieces 7 (side belts 11 and 12 in the example shown in these figures), and straps 70. In the present embodiment, the brassiere A using the support panel 10 will be mainly described.

The brassiere A without the support panel 10 is shown in FIG. 1(*b*). In this case, the back pieces 7 are respectively provided on left and right sides of the cup cover pieces 20. Other components and configurations are the same as those of the brassiere A using the support panel 10.

Each brassiere cup 1 has a double structure including an inner cup 1*i* and an outer cup 10, and is formed by sewing the inner cup 1*i* and the outer cup 1*o*, which have an identical outer shape, together at the perimeters thereof. As described later, each lift-up piece 40 is interposed between the inner cup 1*i* and the outer cup 1*o*, and a lower edge 42 of the lift-up piece 40 is sewn to a lower edge 2 of the brassiere cup 1.

The brassiere cup 1 may have various shapes, such as a shell shape (not shown) and a heart shape shown in FIG. 1, depending on the breast B and the design. As a typical example, a heart-shaped brassiere cup is described herein.

Although the reason is described later, the brassiere cup 1 of the present invention has a double structure as described above, and the inner cup 1*i* and the outer cup lo are respectively imparted with different functions, whereby the brassiere cup 1 not only has improved breast-shaping function and fit but also is excellent in appearance because the lift-up piece 40 does not affect an outerwear T. Thus, the brassiere cup 1 of the present invention is formed such that the thickness thereof obtained by superimposing the inner cup 1*i* on the outer cup 1*o* matches the thickness of a general brassiere cup. However, the thickness of each of the inner cup 1*i* and the outer cup 1*o* is selected as appropriate according to the function.

Figure 5:
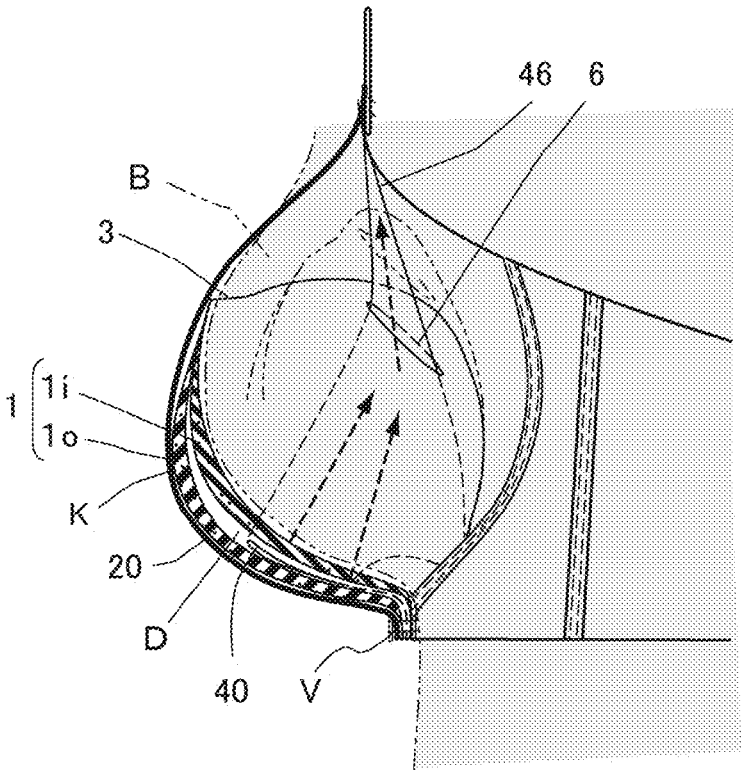
FIG. 5 is a cross-sectional view of a portion of the woman's undergarment on a wearer having large breasts.
Figure 6:
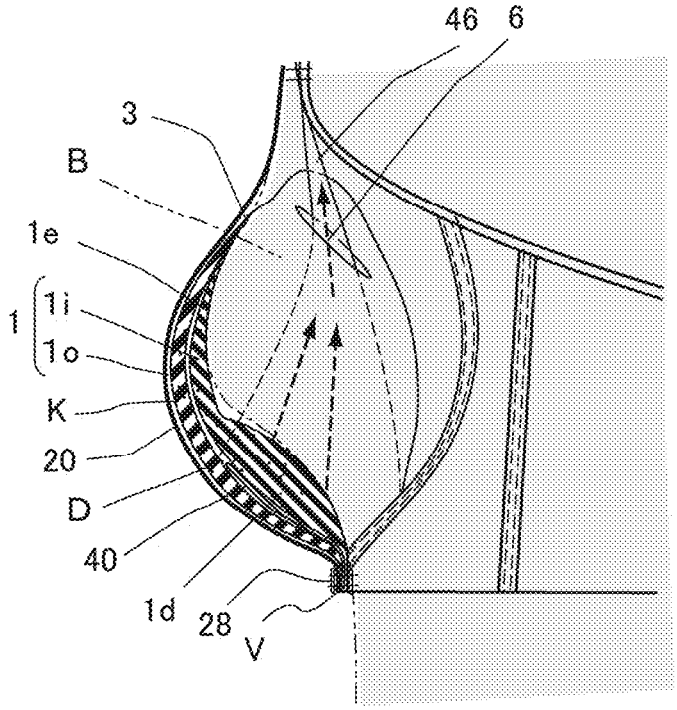
FIG. 6 is a cross-sectional view of a portion of the woman's undergarment on a wearer having small breasts.

In addition, the brassiere cup 1 has various thicknesses to meet the needs of the wearer. For example, a pad (not shown) may be used. When the pad is used, a pocket for housing the pad (not shown) is provided on an inner surface (surface on the wearer side) of the inner cup 1*i*. In FIGS. 5 and 6, a case in which no pad is used is shown.

Figure 2:
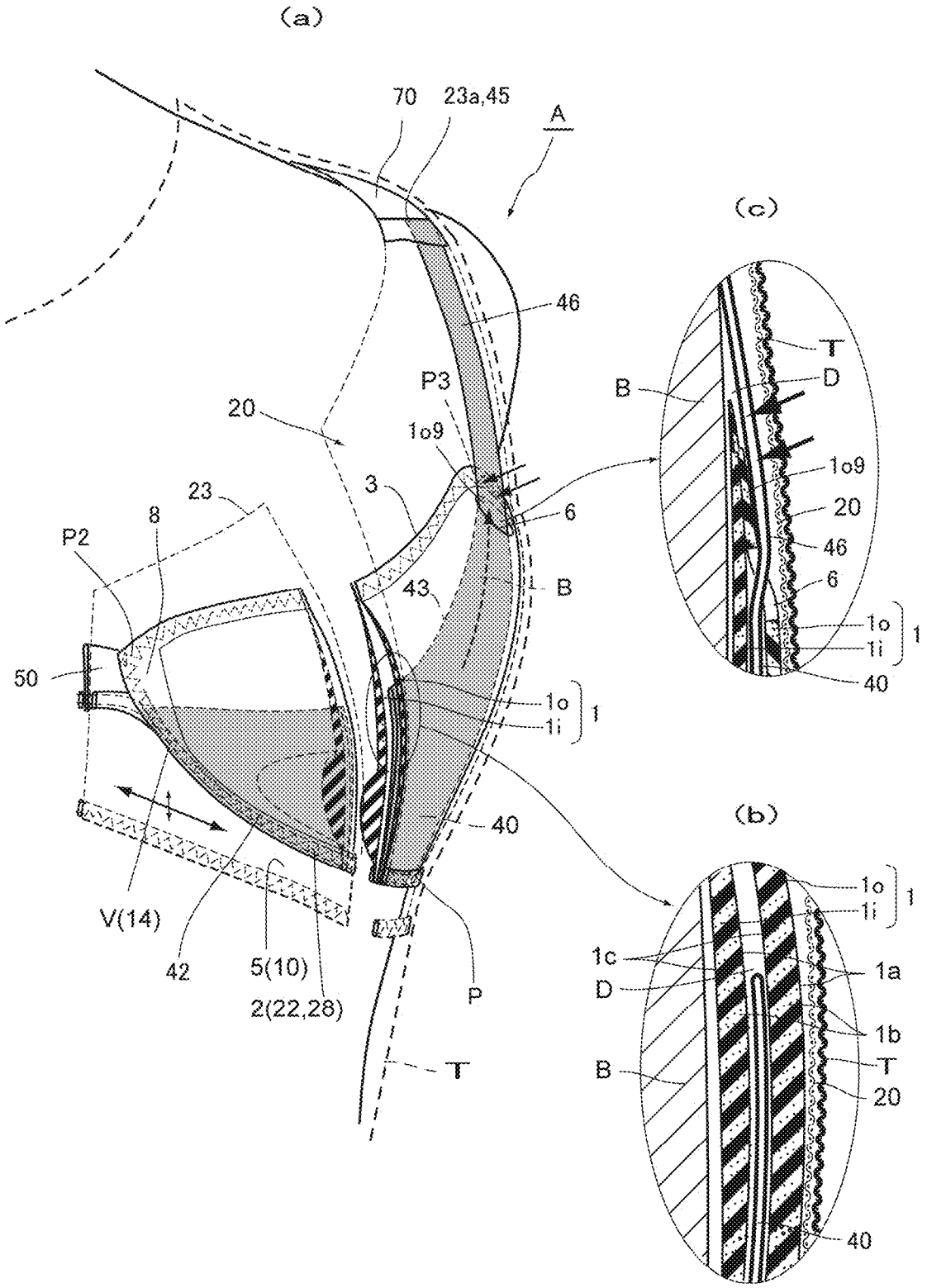
FIG. 2(*a*) is a vertical center sectional view of the woman's undergarment on the wearer shown in FIG. 1(*a*), FIG. 2(*b*) is a partially enlarged view thereof, and FIG. 2(*c*) is an enlarged sectional view of a corner region of a brassiere cup.

When the wearer desires an increased volume of the breast, the inner cup 1*i* having a large thickness is used (FIG. 6). Since the brassiere cup 1 of the present invention has a double structure including the inner cup 1*i* and the outer cup 1*o*, the inner cup 1*i* is used to meet the needs of the wearer by changing the thickness thereof. As described later, the outer cup 1*o* is used to cover a level difference D occurring between the inner cup 1*i* and an upper edge 43 of the lift-up piece 40 and to prevent the level difference D from becoming visible as a line on the outerwear T (FIG. 2).

Various materials are used as the material for the outer cup 1*o* and the inner cup 1*i*. For example, a sheet-like foam-laminated fabric having a three-layer structure composed of an interlayer made of a foam material and thin fabric layers serving as an outer layer and an inner layer attached to the interlayer, or a sheet-like foam-backed fabric having a two-layer structure composed of an interlayer and a thin fabric layer serving as an outer layer, may be used. In the present embodiment, a urethane resin is used as the foam material.

The outer cup 1*o* and the inner cup 1*i* are formed using a foam-laminated or foam-backed fabric as follows. An original foam-laminated or foam-backed fabric is cut into a piece of a desired size, the piece is formed into a desired shape by hot press molding, and then burrs are removed by cutting. Thus, a cup of the above-described predetermined shape is obtained.

In a case where each of the outer cup 1*o* and the inner cup 1*i* is a sheet-like foam-laminated fabric having a three-layer structure, thin fabric layers, as an outer layer 1*a* and an inner layer 1*c*, are attached. In a case of a sheet-like foam-backed fabric having a two-layer structure, a thin fabric layer is provided as an outer layer 1*a* of the outer cup 1*o*, and a thin fabric layer is provided as an inner layer 1*c* of the inner cup 1*i*.

The outer cup 1*o* and the inner cup 1*i* formed of such a foam-laminated or foam-backed fabric have flexibility and elasticity. However, the outer cup 1*o* and the inner cup 1*i* are less stretchable than the lift-up piece 40.

It should be understood that the material for the outer cup 1*o* and the inner cup 1*i* is not limited to those described above, and any other known materials such as a nonwoven fabric and a woven fabric such as a double Raschel fabric may be used.

In the present embodiment, a case using a foam-laminated or foam-backed fabric will be mainly described.

In an example of the inner cup 1*i* using a foam-laminated or foam-backed fabric, the thickness of the inner cup 1*i* is greatest at the center portion and gradually decreases toward the periphery as a whole (FIG. 5).

In another example of the inner cup 1*i* using a foam-laminated or foam-backed fabric, a lower half 1*d* of the inner cup 1*i* along a lower edge 2 of the brassiere cup 1 is thicker than an upper half 1*e* and swells toward an inner surface (breast side), and the upper half 1*e* has a thickness gradually decreasing from the lower half 1*d* toward an upper edge 3 (FIG. 6).

In any of the cases in FIG. 5 and FIG. 6, the outer cup 1*o* using a foam-laminated or foam-backed fabric has a thickness greatest at the center portion and gradually decreasing toward the periphery as a whole. Since the outer cup 1*o* only needs to prevent the level difference D from affecting the outerwear T, it is sufficient that the thickness of the outer cup 1*o* is a thickness that prevents the level difference D in wearing. The same also applies to a case where any other known material such as a nonwoven fabric or a double Raschel fabric is used.

The inner cup 1*i* and the outer cup 1*o* are sewn or adhered at entire perimeters thereof to form one brassiere cup 1, and when the outer surface and inner surface thereof are made to face each other, the thickness is the greatest at a top location K (i.e., the highest position of the outer surface of the brassiere cup 1) and gradually decreases toward the periphery as a whole.

In either case, the entire outer surface of the outer cup 1*o* of the brassiere cup 1 has a gently outwardly curved bowl shape. The brassiere cup 1 of FIG. 5 does not have a thickness corresponding to that of the lower half 1*d* of inner cup 1*i* but may be provided with a pad to increase the thickness. On the other hand, the thicker lower half 1*d* of the inner cup 1*i* of FIG. 6 may be formed of a pad.

The brassiere cup 1 is designed to directly receive the breast B and has an outwardly curved bowl shape. The lower edge 2 of the brassiere cup 1 is downwardly curved so as to fit along a barge scan line V of the wearer. The lowest point of the lower edge 2 is denoted by P, and the ends of the lower edge 2 are an underarm-side end P1 and a sternum-side end P2, respectively. The side edge 4 of the brassiere cup 1 rises from the underarm-side end P1 of the lower edge 2 toward the upper edge 3 to form a laterally convex arc with a large radius of curvature. The upper edge 3 is an edge between the upper end P3 of the side edge 4 and the sternum-side end P2 of the lower edge 2 and has an S-shaped snaking line in the present embodiment.

When the upper edge 3 is divided into three or four equal segments, the point at which the curve of the upper edge 3 changes its shape (i.e., the inflection point) is located at a point P4 one-third to one-fourth distance from the upper end P3 (i.e., two-third to three-fourth distance from the sternum-side end P2). A shorter portion of the upper edge 3 from the upper end P3 to the point P4 forms a gentle upward curve, while a longer portion of the upper edge 3 from the sternum-side end P2 to the point P4 also forms a gentle upward curve. These upward curves are connected smoothly to a downward curve at the point P4. The lower edge 2, the upper edge 3, and the side edge 4 are connected smoothly by circular arcs (see FIG. 1).

The lower edge 2, the upper edge 3, and the side edge 4 of the brassiere cup 1 are described separately for easier understanding, but a combination of the upper edge 3 and the side edge 4 may be considered as one upper edge.

A region around a portion where the upper edge 3 and the side edge 4 of the brassiere cup 1 meet with each other is a corner region, and the portion is referred to as an upper end P3. The corner region 1*o*9 of the outer cup 1*o* forming the brassiere cup 1 is provided with an opening 6.

This opening 6 is a slit-like opening formed in the vicinity of the side edge 4 to extend approximately parallel to the side edge 4 of the brassiere cup 1 (i.e., outer cup 10). As described later, the slit-like opening 6 is formed in a direction intersecting (perpendicular or approximately perpendicular to) the longitudinal direction of an insertion portion 46 to be inserted through the slit-like opening 6.

The length (slit length) 6*w* of the slit-like opening 6 is equal to or greater than a width 46*w* of the insertion portion 46 adapted to pass through the opening 6.

The cup cover piece 20 is a thin cloth disposed to cover the entire surface of the brassiere cup 1. The upper edge 3 and the side edge 4 of the brassiere cup 1 are not sewn to the cup cover piece 20, and only the lower edge 2 of the brassiere cup 1 is sewn to the lower edge 22 of the cup cover piece 20, and thus the cup cover piece 20 is separated from the outer surface of the brassiere cup 1. The lower edge 2 of the brassiere cup 1 is sewn over the entire length from the underarm-side end P1 to the sternum-side end P2. The underarm-side end P1 is disposed between a lowest point P of the lower edge 2 and an armhole-side end 22*a* extending to an armhole 25. A side edge 24 of the cup cover piece 20 serves as a portion of the armhole 25 at an edge extending from the armhole-side end 22*a* to a strap connecting portion 23*a*.

The cup cover piece 20 may be a single piece as shown in FIG. 4 or may be composed of two pieces (not shown). When the cup cover piece 20 is composed of two pieces, it has the same shape as that of a single piece if the pieces are sewn together.

The single-piece cup cover piece 20 is formed into a gently sloping bowl shape that conforms to the shape of the outer surface of the brassiere cup 1 by hot press molding. As the material, a fabric that can be formed by hot press molding, such as a power net fabric made of a stretchable material like polyurethane fibers or a knitted lace fabric, is used. Alternatively, a thin lace fabric made of a stretchable material (in particular, in FIG. 1, a material that is more stretchable in the transverse direction (i.e., a direction perpendicular to an upper edge 23) than in the longitudinal direction (i.e., a direction parallel to the upper edge 23) is used.

The two-piece cup cover piece 20 is composed of an upper part and a lower part. As the material, a fabric which is less stretchable and thus unsuitable for hot press molding is used. The upper part and the lower part are sewn together at the connection portion to form a piece of fabric having an outwardly curved shape that conforms to the shape of the outer surface of the brassiere cup 1.

As shown in FIG. 4, the lower edge 22 of the cup cover piece 20 has a downward "U" shape along the barge scan line V. One end of the lower edge 22 is the armhole-side end 22*a* and the other end thereof is a connecting end 22*b*. The side edge 24 serving as a portion of the armhole 25 rises from the armhole-side end 22*a* and extends to the strap connecting portion 23*a*. The edge extending between the strap connecting portion 23*a* and the connecting end 22*b* is the upper edge 23.

The lower edge 22 of the cup cover piece 20 is longer than the lower edge 2 of the brassiere cup 1, and the lower edge 2 of the brassiere cup 1 is sewn to a portion of the lower edge 22 of the cup cover piece 20 between the armhole-side end 22*a* and the connecting end 22*b*.

The lower edge 2 of the brassiere cup 1 from its underarm-side end P1 to its sternum-side end P2 is sewn to the lower edge 22 of the cup cover piece 20. As described above, the underarm-side end P1 is disposed between the lowest point P of the lower edge 2 and the armhole-side end 22*a* extending to the armhole 25.

The cup cover piece 20 is more stretchable obliquely upward from the lower edge 22 toward the strap connecting portion 23*a* (toward the shoulder) but less stretchable in a direction perpendicular to the obliquely upward direction, as shown by arrows in FIG. 4.

It should be noted that the cup cover piece 20 is less stretchable in these directions than a lift-up piece 40 to be described next.

The lift-up piece 40 is provided between the inner cup 1*i* and the outer cup 1*o* of the brassiere cup 1. The lower edge 42 of the lift-up piece 40 is formed in a shape corresponding to the lower edge 2 of the brassiere cup 1, and is integrally sewn or adhered to the lower edge 2. The upper edge 43 of the lift-up piece 40 is a straight edge extending from the sternum-side end Q2 of the lower edge 42 toward the strap 70, and the side edge 44 of the lift-up piece 40 is an edge extending from the underarm-side end Q1 of the lower edge 42 toward the strap 70. A narrow strip portion between the upper edge 43 and the side edge 44 is the insertion portion 46, and the upper end of the insertion portion 46 is an upper end edge 45 connected to the strap 70. This insertion portion 46 is inserted through the opening 6 of the outer cup 1*o* of the brassiere cup 1, as described later.

The material of the lift-up piece 40 is a Spandex fabric or a power net fabric. Here, the lift-up piece 40 is a folded double-layer piece, and the upper edge 43 is a folded edge extending in a straight line (FIG. 4). The side edge 44 is inwardly curved to form a deep concave.

The insertion portion 46 between the upper part of the upper edge 43 and the upper part of the side edge 44 extends in a narrow strip as described above, and the upper end edge 45 of the insertion portion 46 is connected to the breast-side end of the strap 70.

The side edges 44 that are cut edges of the folded lift-up piece 40 are sewn together to form a double-layer structure in a sewing manner that does not impair stretchability thereof.

As shown in FIG. 4, the lift-up piece 40 is more stretchable in a direction parallel to the upper edge 43 than in a direction perpendicular to the parallel direction, as indicated by crossing arrows. Therefore, when tension is applied to the lift-up piece 40 on the wearer, a high tension is generated in a region between the lower edge 42 and the upper end edge 45 and thus the lift-up piece 40 is significantly stretched from the lower edge 42 toward the shoulder. On the other hand, the lift-up piece 40 is less stretchable in a direction perpendicular to the stretching direction and thus a portion of the breast B corresponding to that less stretchable region is effectively pushed (medially) toward the sternum in the center of the chest.

Figure 3:
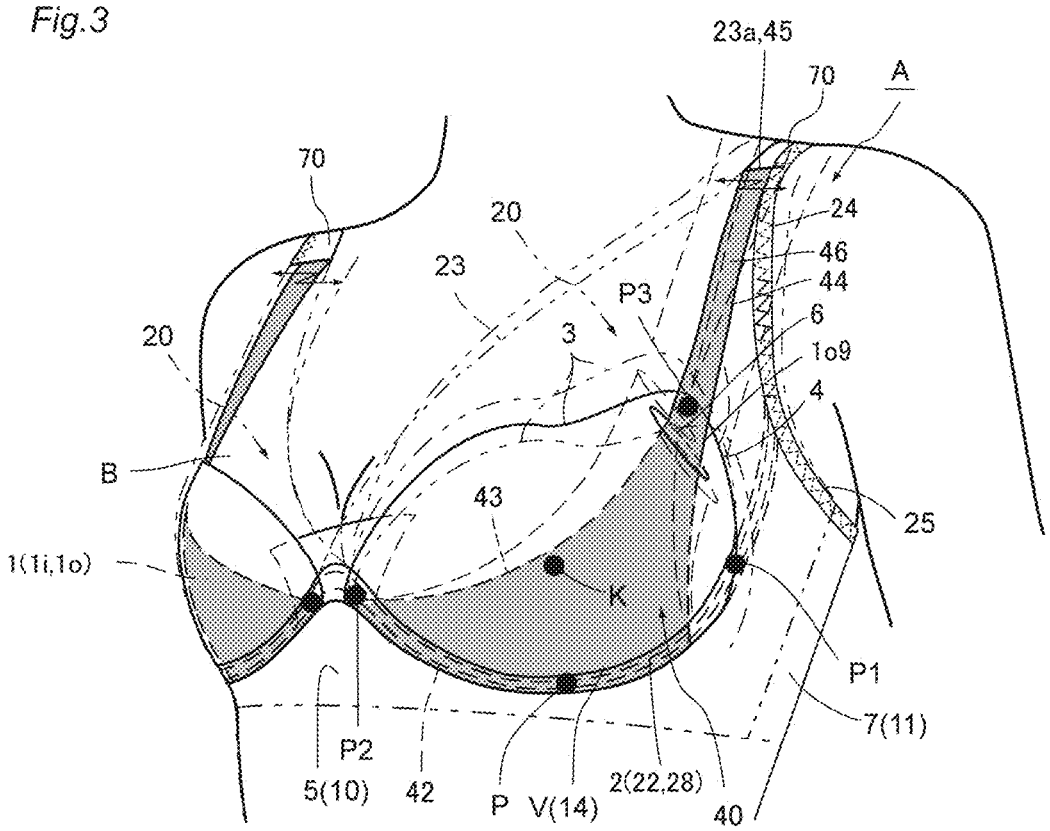
FIG. 3 are perspective views of the woman's undergarment of FIG. 1, from which cup cover pieces are removed, showing how straps, lift-up pieces, and brassiere cups move, and FIG. 3(*a*) is the perspective view of the lift-up pieces of one embodiment and FIG. 3(*b*) is the perspective view of the lift-up pieces of another embodiment.
Figure 3:
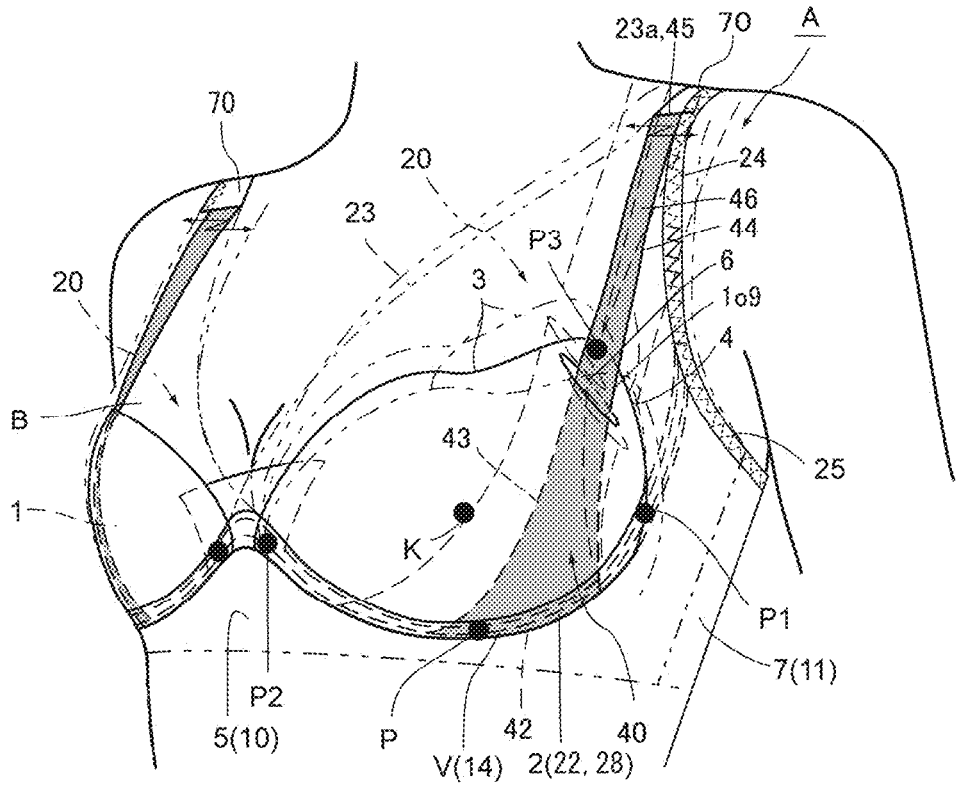

When the lower edge 42 of the lift-up piece 40 is wider as shown in FIG. 3(*a*), the lower edge 42 can fit a larger portion of the breast to lift up the entire breast B with the inner cup 1*i*.

When the lower edge 42 of the lift-up piece 40 is narrower and the lower edge 42 is sewn onto the underarm-side end P1 side over the area including the lowest point P of the brassiere cup 1 as shown in FIG. 3(*b*), the breast is pushed, with the inner cup 1*i*, from the underarm-side end P1 side toward the center of the chest more effectively.

The lift-up piece 40 inside the brassiere cup 1 is covered with the outer cup 1*o*, and the linear level difference D occurring along the upper edge 43 of the lift-up piece 40 does not become visible on the outer surface of the outer cup 1*o*.

The support panel 10 serving as a front portion 5 of the woman's undergarment A is optionally provided. Here, the undergarment A provided with the support panel 10 is shown as a typical example. For example, as shown in FIG. 4, the support panel 10 has left and right cup-shaped edges 13 that form a W shape composed of two arcs. Side belts 11 and 12 serving as left and right back pieces 7 of the woman's undergarment A extend in the left and right directions from the support panel 10 (FIG. 1(*a*)). (Alternatively, in a case where the support panel 10 is not used, the side belts 11 and 12 extend in the left and right directions from the cup cover pieces 20 (FIG. 1(*b*)).)

The lower edges 22 of the left and right cup cover pieces 20, the lower edges 42 of the lift-up pieces 40, the lower edges 2 of the brassiere cups 1, and a non-stretchable tape 28 are stacked on top of one another and sewn together to the cup-shaped edges 13, and thus a narrow strip-like W-shaped cup supporting portion 14 which is fitted into the barge scan line V is formed.

In the present embodiment, this portion (the cup supporting portion 14) is not provided with an underwire. Therefore, unlike underwire brassiere cups, the shape of the cup supporting portion 14 serving as the lower edges of the cup sections is not uniquely determined. The cup supporting portion 14 is more flexible than the underwire of the brassiere cups. The cup supporting portion 14 is thick and flexible but does not have longitudinal stretchability. The cup supporting portion 14 softly touches the barge scan lines V of the breasts B of the wearer. The tension of the lift-up pieces 40 along the cup supporting portion 14 is generated in the lower edges 42 of the lift-up pieces 40, as described above.

In the embodiment shown in the figures, the support panel 10 and the side belts 11 and 12 are made of a fabric, such as a lace fabric. The end of one side belt 11 is provided with male engaging members 11*a*, while the end of the other side belt 12 is provided with female to-be-engaged members 12*a*. The support panel 10 and the side belts 11 and 12 are more elastically stretchable in their longitudinal (lengthwise) directions than in their transverse (widthwise) directions, as shown by crossing arrows in FIG. 4.

When the support panel 10 is not provided, the connecting ends 22*b* of the brassiere cups 1 are connected to each other with a cup connecting piece 50, and the non-stretchable tape 28 and the lower edges 2 of the brassiere cups 1 are sewn together so as to increase the strength. In this case, the side belts 11 and 12 serving as the back pieces 7 of the woman's undergarment A extend in the left and right directions (FIG. 1(*b*)), starting from the lower edges 22 (in particular, positions corresponding to the lowest points P, in the lower edges 22, of the brassiere cups 1) of the cup cover pieces 20 up to the armhole-side ends 22*a*, or from positions corresponding to the underarm-side ends P1.

The above-described cup connecting piece 50 is a piece of cloth for connecting the left and right brassiere cups 1 adjacent to each other at their adjacent portions (abutting portions) 8 near the sternum-side ends P2 of the upper edges 3. As the cup connecting piece 50, a highly stretchable double-folded fabric such as a power net fabric is used. The cup connecting piece 50 is more elastically stretchable in a direction connecting the left and right brassiere cups 1 than in a direction perpendicular to that connecting direction. The side edges of the cup connecting piece 50 are sewn to the adjacent portions 8 near the sternum-side ends P2 as described above, and the lower edge of the cup connecting piece 50 is sewn to a portion, of the narrow strip-like W-shaped cup supporting portion 14, including an inverted U-shaped portion 52 located between the left and right cup-shaped edges 13 of the support panel 10.

Since the cup connecting piece 50 is used to connect the left and right brassiere cups 1, it is exposed to the outside through a space between the brassiere cups 1. In this embodiment, the shape, structure, and location of the cup cover pieces 20 are changed to hide the cup connecting piece 50.

More specifically, the connecting end 22*b* of the left cup cover piece 20 reaches the lower edge 2 of the right brassiere cup 1 and the connecting end 22*b* of the right cup cover piece 20 reaches the lower edge 2 of the left brassiere cup 1, so that the cup cover pieces 20 overlap each other above the cup connecting piece 50 to hide it.

Each of the lift-up pieces 40, which are sewn to the brassiere cups 1 and the support panel 10 at their lower edges 42, covers the outer surface lower part of the inner cup 1*i* of the brassiere cup 1, and the insertion portion 46 of the lift-up piece 40 is inserted through the slit-like opening 6 in the corner region 1*o*9 of the outer cup 1*o* from an inner surface to an outer surface. The upper end edge 45 of the lift-up piece 40 is connected to one end (i.e., breast-side end) of the strap 70 together with the strap connecting portion 23*a* of the cup cover piece 20. The other end (i.e., back-side end) of the strap 70 is connected to the center of the upper edge of the side belt 11 (or 12).

The width 46*w* of the insertion portion 46 of the lift-up piece 40 is equal to or smaller than the slit-like opening length 6*w* of the slit-like opening 6, as described above. In the case where the width 46*w* of the insertion portion 46 is smaller than the slit length 6*w*, the insertion portion 46 can move more easily in its longitudinal direction through the slit-like opening 6 than in the case where the slit length 6*w* is equal to the width 46*w* of the insertion portion 46, because the contact resistance in the former case is lower than that in the latter case. Furthermore, when the slit-like opening length 6*w* is greater than the width 46*w* of the insertion portion 46, the range of motion of the insertion portion 46 increases in the slit length direction. Therefore, even if the position of the strap 70 varies depending on the wearer's body shape (for example, the distance between the left and right straps 70 increases when the wearer has broad shoulders, while the distance decreases when the wearer has narrower shoulders), the slit-like opening 6 with an extra length accommodates the positional variations of the strap and thus the brassiere cup 1 can always be located over the breast B.

As seen from FIG. 1, the upper edge 43 of the lift-up piece 40 passes through or slightly above or below a position corresponding to the top position K of the brassiere cup 1.

Next, the operations of the woman's undergarment A on a wearer will be described. When the woman's undergarment A is worn, the side belts 11 and 12 are connected by engaging members 11*a* and to-be-engaged members 12*a* and thus the support panel 10 stretches and fits snugly against the chest of the wearer, while the straps 70 pull up the cup cover pieces 20 and the lift-up pieces 40 toward the shoulders, as shown by arrows (see FIG. 1).

The cup supporting portion 14 fits under the barge scan lines V of the breasts B and supports them from below. Since the cup supporting portion 14 is not provided with an underwire, it flexibly changes its shape to conform to the size of the breasts B or the shape of the barge scan lines V of the breasts B and thus softly touches the barge scan lines V, although it is not stretchable (improved fit).

Since the entire lower edge 2 of the brassiere cup 1, the lower edge 22 of the cup cover piece 20, and the lower edge 42 of the lift-up piece 40 are sewn as described above, the breast B is pulled up at the lower edge 42 of the lift-up piece 40 with the inner cup 1*i* of the brassiere cup 1.

The insertion portion 46 of the lift-up piece 40 is inserted through the slit-like opening 6 provided in the corner region 1*o*9 of the outer cup 1*o* of the brassiere cup 1 from the inner surface to the outer surface. The slit-like opening 6 can easily move within a certain range in its longitudinal direction, with respect to the insertion portion 46 connected to the strap 70 and hung from the shoulder. In other words, the brassiere cup 1 can move with respect to the insertion portion 46 of the lift-up piece 40.

A portion of the insertion portion 46 inserted through the slit-like opening 6 is narrower than the slit-like opening 6 as described above, but as seen from FIG. 1, the width of the insertion portion 46 suddenly increases from a position slightly below the slit-like opening 6 (for example, a position about 10 mm below the slit-like opening 6 toward the lower edge 42) and exceeds the slit length 6*w* of the slit-like opening 6. Thus, the unlimited longitudinal movement of the insertion portion 46 through the brassiere cup 1 is prevented.

In this relationship between the brassiere cup 1 and the lift-up piece 40, when the strap 70 moves in the horizontal direction, the insertion portion 46 also moves in its width direction (i.e., the slit length direction of the opening 6) and is caught on the edge of the slit-like opening 6, and thus the brassiere cup 1 also moves by a distance equal to that of the movement of the strap 70 after the insertion portion 46 is caught on the edge. In other words, the movement of the upper edge 3 and the side edge 4 of the brassiere cup 1 is limited within a certain range in the horizontal direction by the insertion portion 46 thus inserted. More specifically, the upper edge 3 and the side edge 4 of the brassiere cup 1 are not completely free. The movement of these edges are limited within a certain range by the lift-up piece 40, and thus the instability of the brassiere cup 1 is eliminated.

When the brassiere A is worn, if the breast B is too large to be received in the brassiere cup 1 as shown in FIG. 5, the brassiere cup 1 is pushed by the large breast B therein and leans forward, with the lower edge 2 fixed as a fulcrum. In this case, the slit-like opening 6 of the outer cup lo of the brassiere cup 1 smoothly moves downward along the insertion portion 46 of the lift-up piece 40, and thus the brassiere cup 1 can receive and cover the breast B.

In contrast, if the breast B is too small for the brassiere cup 1 as shown in FIG. 6, the brassiere cup 1 rises upward, with the lower edge 2 fixed as a fulcrum, under the tension of the cup cover piece 20 that covers the outer surface of the brassiere cup 1. In this case, the slit-like opening 6 of the outer cup 10 of the brassiere cup 1 smoothly moves upward along the insertion portion 46 of the lift-up piece 40, and the brassiere cup 1 can receive and cover the breast B.

This leaning and rising of the brassiere cup 1 is performed by the cup cover piece 20 that is connected to the strap 70 and covers the entire outer surface of the brassiere cup 1.

With the use of the brassiere cup 1 having a thicker lower half 1*d* (or having a lower half 1*d* provided with a thick pad) as shown in FIG. 6, the effect of increasing the volume of the breast can be enhanced.

In either case, since the brassiere cup 1 can lean forward or rise upward as described above, it can receive breasts with a wider range of sizes. In addition, since the cup supporting portion 14 is a wireless portion without an underwire, a cup of a size can cover cup sizes around that size, and thus the number of cup sizes can be reduced from that of conventional brassieres provided with underwires.

Next, in a case where the wearer of the woman's undergarment A wears the outerwear T over the woman's undergarment A, the outerwear T is in contact with the cup cover pieces 20 of the brassiere A (FIG. 2).

Figure 7:
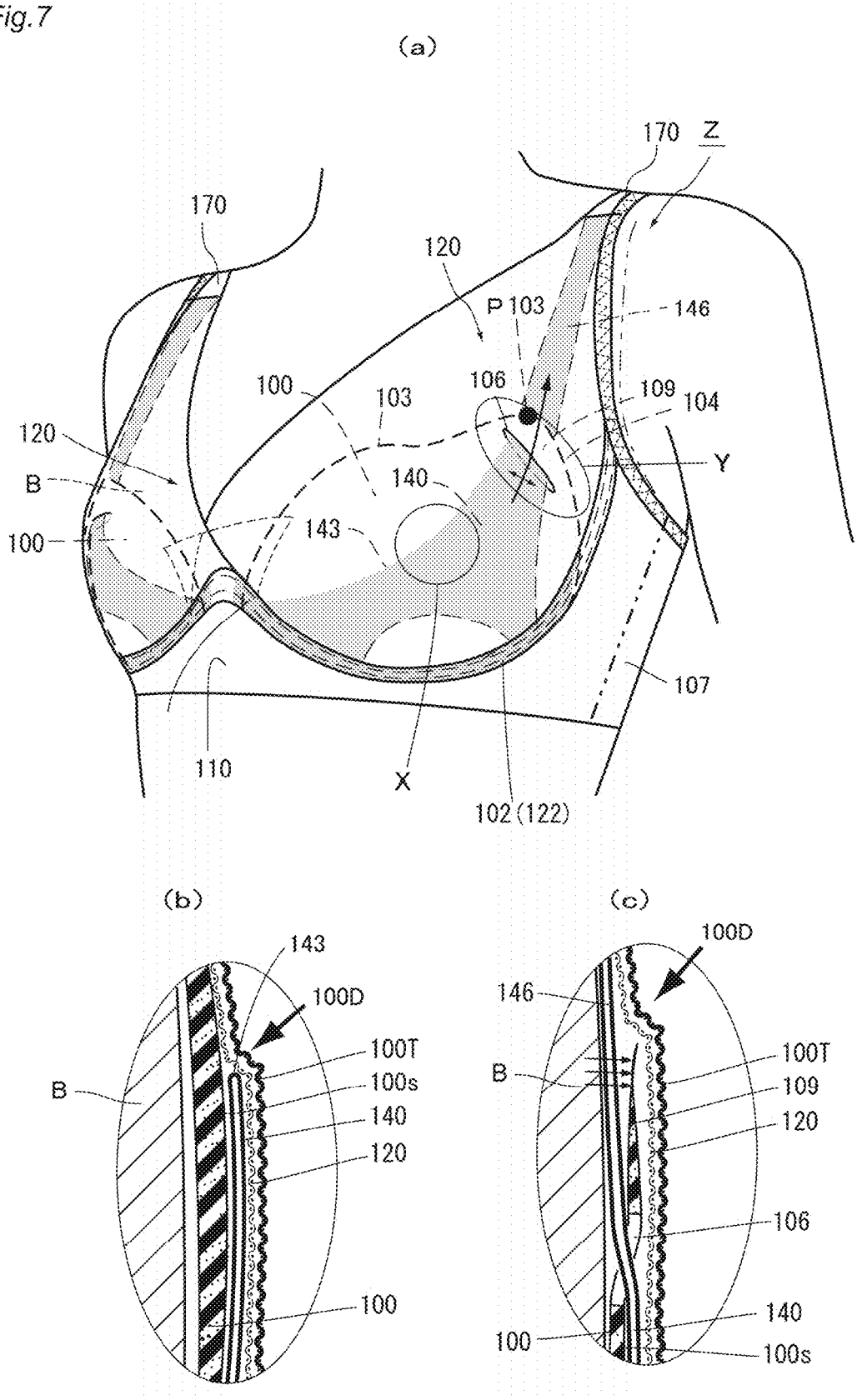
FIG. 7(*a*) is a perspective view of a woman's undergarment according to a conventional example on a wearer, FIG. 7(*b*) is an enlarged sectional view of an X portion, and FIG. 7(*c*) is an enlarged sectional view of a Y portion.

In a conventional woman's undergarment Z, the lift-up piece 140 is provided on the outer surface of the brassiere cup 100 as shown in FIG. 7(*b*), and thus the level difference 100D having the thickness of the lift-up piece 140 occurs between the outer surface 100*s* of the brassiere cup 100 and the upper edge 143 of the lift-up piece 140. The cup cover piece 120 is provided on the lift-up piece 140, and a thin fabric such as a lace fabric covers the level difference 100D and thus bends along the level difference 100D, so that the level difference 100D cannot be eliminated. As a result, the outerwear 100T in contact with the cup cover pieces 20 is also affected, and a line along the level difference 100D becomes visible on an outer surface of the outerwear 100T.

In the conventional woman's undergarment Z, as shown in FIG. 7(*c*), the insertion portion 146 of the lift-up piece 140 is inserted through the opening 106 in the corner region 109 of the brassiere cup 100 from an outer surface to an inner surface. As a result, the corner region 109 is outwardly pressed by the insertion portion 146 slipping under the inner surface, and the level difference 100D occurs on the outwardly pressed portion. The level difference 100D affects the outerwear 100T as in the above description.

In contrast, as described above, in the present invention, a portion lower than the insertion portion 46 of the lift-up piece 40 is housed inside the brassiere cup 1, and the level difference D due to the upper edge 43 of the lift-up piece 40 is covered by the outer cup 1*o* and is prevented from becoming visible on the outer surface of the outer cup 1*o*. As a result, there is no influence on the outerwear T (FIG. 2(*b*)).

In addition, the insertion portion 46 of the lift-up piece 40 is inserted through the opening 6 in the corner region 1*o*9 of the outer cup 1*o* of the brassiere cup 1 from the inner surface toward the outer surface. As a result, the insertion portion 46 located on the outer surface side presses against the outer surface of the corner region 1*o*9, and thus the corner region 1*o*9 does not float toward the outer surface and the level difference D does not occur in this portion. There is no influence on the outerwear T in this portion as in the above description.

As described above, it is possible to provide the woman's undergarment with cup sections that not only has improved body-shaping function and fit but also is excellent in appearance because the lift-up pieces do not affect the outerwear.

REFERENCE SIGNS LIST

A woman's undergarment
B breast
D level difference
K top location
P lowest point
P1 underarm-side end
P2 sternum-side end
P3, P103 upper end of side edge
P4 point one-third to one-fourth distance from upper end of side edge
Q1 underarm-side end of lift-up piece
Q2 sternum-side end of lift-up piece
T outerwear
V barge scan line
Z conventional woman's undergarment
1 brassiere cup
1*a* outer layer
1*b* interlayer
1*c* inner layer
1*d* lower half
1*e* upper half
1*i* inner cup
1*o* outer cup
1*o*3 upper edge
1*o*4 side edge
1*o*9 corner region of outer cup
2 lower edge
3 upper edge
4 side edge
5 front portion
6 opening
6*w* length of opening (slit length)
7 back piece
8 adjacent portion near sternum-side end of brassiere cup
10 support panel
11, 12 side belt
11*a* engaging member
12*a* to-be-engaged member
13 cup-shaped edge
14 cup supporting portion
20 cup cover piece
22 lower edge
22*a* armhole-side end
22*b* connecting end
23 upper edge of cup cover piece
23*a* strap connecting portion
24 side edge
25 armhole
28 tape
40 lift-up piece
42 lower edge of lift-up piece
43 upper edge of lift-up piece
44 side edge of lift-up piece
45 upper end edge
46 insertion portion
46*w* width of insertion portion
50 cup connecting piece
52 inverted U-shaped portion
70 strap
100 brassiere cup
100D level difference
100*s* outer surface of brassiere cup
100T outerwear
102 lower edge
103 upper edge
104 side edge
106 opening
107 back piece
109 corner region of brassiere cup
110 support panel
120 cup cover piece
122 lower edge
140 lift-up piece
143 upper edge of lift-up piece
146 insertion portion
170 strap

The invention claimed is:

1. A woman's undergarment with cup sections, comprising:

a pair of left and right brassiere cups each adapted to receive a breast and having a lower edge, a side edge, and an upper edge, the lower edge being downwardly curved, the side edge rising from a first end of the lower edge toward the upper edge, the upper edge extending from a second end of the lower edge to an upper end of the side edge;

cup cover pieces each disposed to cover an outer surface of the brassiere cup and separated from the outer surface of the brassiere cup, in which the lower edge of the brassiere cup extending from the first end to the second end is sewn to a lower edge of the cup cover piece, and the side edge and the upper edge of the brassiere cup are provided without being sewn to the cup cover piece;

straps each sewn to the cup cover piece; and lift-up pieces each having a lower edge sewn to the lower edge of the brassiere cup, and an upper end edge connected to the strap, wherein the brassiere cup is formed to have a double structure including an inner cup and an outer cup provided on an outer surface of the inner cup, the brassiere cup has an opening in a corner region including a portion where an upper edge and a side edge of the outer cup meet with each other, the lift-up piece is disposed between the inner cup and the outer cup, the lift-up piece includes an insertion portion having a strip shape extending toward the upper end edge, and the insertion portion is inserted through the opening in the corner region from an inner surface to an outer surface and is provided so as to press against the outer surface of the corner region.

2. The woman's undergarment with cup sections according to claim 1, wherein the inner cup and the outer cup have an identical outer shape and are integrally sewn or adhered at entire perimeters of the inner cup and the outer cup.

3. The woman's undergarment with cup sections according to claim 1, wherein a material of the inner cup and the outer cup to be used is any one of: a foam-laminated fabric having a three-layer structure composed of an interlayer made of a foam material and thin fabric layers serving as an outer layer and an inner layer attached to the interlayer; a foam-backed fabric having a two-layer structure composed of an interlayer and a thin fabric layer serving as an inner layer of the inner cup or an outer layer of the outer cup; a nonwoven fabric; and a woven fabric.

4. The woman's undergarment according to claim 1, wherein the opening in the corner region is formed in a slit shape extending in a direction intersecting a longitudinal direction of the insertion portion.

5. The woman's undergarment according to claim 4, wherein the opening has a length greater than a width of the insertion portion.

* * * * *